US010385493B2

(12) United States Patent
Schwane et al.

(10) Patent No.: US 10,385,493 B2
(45) Date of Patent: Aug. 20, 2019

(54) LOOP GRIPPER WITH RETAINING ELEMENT

(71) Applicant: Groz-Beckert KG, Albstadt (DE)

(72) Inventors: Herbert Schwane, Raesfeld (DE); Bernd Hillenbrand, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 184 days.

(21) Appl. No.: 15/548,167

(22) PCT Filed: Jan. 20, 2016

(86) PCT No.: PCT/EP2016/051126
§ 371 (c)(1),
(2) Date: Aug. 2, 2017

(87) PCT Pub. No.: WO2016/124401
PCT Pub. Date: Aug. 11, 2016

(65) Prior Publication Data

US 2018/0023233 A1 Jan. 25, 2018

(30) Foreign Application Priority Data

Feb. 3, 2015 (DE) ..... 10 2015 101 495

(51) Int. Cl.
*D05C 15/24* (2006.01)
*D05C 15/22* (2006.01)

(52) U.S. Cl.
CPC ..... *D05C 15/22* (2013.01); *D05C 15/24* (2013.01)

(58) Field of Classification Search
CPC ..... D05C 15/24; D05C 15/22; D05C 15/36
See application file for complete search history.

(56) References Cited

U.S. PATENT DOCUMENTS 2,982,239 A 5/1961 McCutchen
3,084,645 A 4/1963 Card
(Continued)

FOREIGN PATENT DOCUMENTS

DE 1585127 A1 3/1970
DE 19521760 A1 12/1995
(Continued)

OTHER PUBLICATIONS

International Search Report in corresponding International Application No. PCT/EP2016/051126, dated Mar. 26, 2016, 4 pages.
(Continued)

*Primary Examiner* — Tajash D Patel
(74) *Attorney, Agent, or Firm* — Fitch, Even, Tabin & Flannery LLP

(57) ABSTRACT

A loop gripper (10) for a tufting machine has a gripper body (11) with a gripper finger (12) extending in an extension direction E from a retained end (13) to a free end (14). On the gripper finger (12) underside (16), a cutting region (20) transitions into a sliding surface (19) at a transition point (21). A retaining element (35) near the transition point (21) is mounted to be pivotable about a pivot axis S relative to the gripper finger (12). The pivot axis S extends in a transverse direction Q at right angles to the extension direction E. The retaining element (35) is urged into a starting position A by a force, for example a spring force and/or a weight force. In the starting position A, a retaining surface (37) of the retaining element (35) extends obliquely or at right angles away from the sliding surface (19).

18 Claims, 3 Drawing Sheets

(56) References Cited

U.S. PATENT DOCUMENTS

| | | | | |
|---|---|---|---|---|
| 3,222,891 | A | 12/1965 | Wignall | |
| 4,048,930 | A | 9/1977 | Card | |
| 4,134,347 | A | 1/1979 | Jolley et al. | |
| 4,245,574 | A * | 1/1981 | Wilson | D05C 15/36 112/80.4 |
| 4,353,317 | A | 10/1982 | Crumbliss | |
| 5,509,364 | A | 4/1996 | Bardsley | |
| 8,302,546 | B2 * | 11/2012 | Bitzer | D05C 15/22 112/80.5 |
| 9,739,002 | B2 * | 8/2017 | Beach | D05C 15/24 |
| 2008/0264314 | A1 * | 10/2008 | Hillenbrand | D05C 15/22 112/80.5 |
| 2012/0024208 | A1 | 2/2012 | Buechle et al. | |
| 2017/0058439 | A1 | 3/2017 | Beach et al. | |

FOREIGN PATENT DOCUMENTS

| | | | |
|---|---|---|---|
| DE | 102014102801 | A1 | 9/2015 |
| EP | 0200810 | A1 | 11/1986 |
| EP | 2412860 | A1 | 2/2012 |

OTHER PUBLICATIONS

Demand Filed in corresponding International Application No. PCT/EP2016/051126, dated Nov. 30, 2016, 3 pages.

Notification of the International Preliminary Report on Patentability in corresponding International Application No. PCT/EP2016/051126, dated Feb. 10, 2017, 8 pages.

German office action in corresponding German Application No. DE 10 2015 101 495.5, dated Dec. 15, 2015, 6 pages.

* cited by examiner

LOOP GRIPPER WITH RETAINING ELEMENT

CROSS REFERENCE TO RELATED APPLICATIONS

This patent application is the national phase of PCT/EP2016/051126 filed Jan. 20, 2016, which claims the benefit of German Patent Application No. 10 2015 101 495.5 filed Feb. 3, 2015.

TECHNICAL FIELD

The invention relates to a loop gripper for a tufting machine, in particular for producing cut pile.

BACKGROUND

Loop grippers for tufting machines are known from the prior art in various designs. The loop gripper according to U.S. Pat. No. 3,084,645 has a gripper body with a gripper finger which extends in an extension direction from a retained end to a free end. On the underside of the gripper finger, there is a cutting region which cooperates with a cutting blade. Yarn loops which are located in the cutting region can be cut by the cutting blade to produce cut pile. Also attached to the gripper body is a spring clip which cooperates with the free end of the gripper finger and in a rest position bears against a side surface of the gripper finger. Formed between the spring clip and the side surface is a gap, into which the needle or one leg of the needle can engage when the gripper finger grips a yarn loop. The yarn loop can be cut by means of the cutting blade, or alternatively, in order to produce a loop pile, can be drawn off from the gripper finger without being cut.

Another loop gripper is described in U.S. Pat. No. 4,134,347. In contrast to U.S. Pat. No. 3,084,645, the gripper finger has at its free end a protrusion which protrudes transversely away from the edge provided in the cutting region. This prevents yarn loops from being able to be drawn off from the cutting region. By way of a pivotable closing element which collaborates with the protrusion at the free end of the gripper finger, the ingress of yarn loops into the cutting region can be prevented so that, instead of cut pile, it is also possible to produce loop pile if the yarn loops are gripped by the free end of the gripper finger without being able to enter the cutting region.

In the loop gripper known from U.S. Pat. No. 4,353,317, two gripper fingers are provided, each having a cutting region, wherein the lower gripper finger is assigned a closing element which collaborates with a protrusion at the free end of the gripper finger in order to prevent yarn loops from entering the cutting region. A shorter pile is produced when the closing element is in the closed position, and a longer pile is produced when the closing element is open.

U.S. Pat. No. 2,982,239 describes a loop gripper having a straight gripper finger, which has a cutting region, and a hook-shaped further gripper finger, said gripper fingers being pivotable relative to one another. Depending on the pivoting position, the hook-shaped gripper finger can cause the loops held on the straight gripper finger to be retained for cutting purposes (cut pile production) or can unblock the cutting region of the straight gripper finger (loop pile production).

SUMMARY

When producing cut pile, use is usually made of cutting edges in the cutting region of the gripper finger and/or of additional cutting blades which are movable relative to the gripper finger. The problem often exists that the loops are cut unsymmetrically such that the disparity in the resulting fibers leads to a visibly uneven pile height. This problem may be further amplified by the fact that, in the case of yarns made of very slippery material, the yarn loops slip in the extension direction of the gripper finger during the cutting operation and thereby warp due to the increasing tension in the yarn loop. This can lead to the situation whereby the yarn loop is not cut into two pile threads of equal length. This problem occurs to an increased extent particularly in the case of very slippery materials which at the same time are difficult to cut, such as for example in the case of certain plastic yarns, for instance in the case of polyester threads or in the case of coated threads such as those used to produce dirt-repellant carpets.

The object of the invention is therefore to provide a loop gripper which avoids the aforementioned problems and improves the quality of the pile produced, particularly cut pile.

The loop gripper according to the invention has a gripper body with a gripper finger. The gripper finger is in particular an integral part of the gripper body. The gripper finger extends in an extension direction from a retained end to a free end. On its underside, the gripper finger has a cutting region and, adjacent to the cutting region, a sliding surface. The sliding surface directly adjoins the cutting region and is provided between the cutting region and the free end of the gripper finger. Yarn loops can slide along the sliding surface in the region of their apex and can be guided into the cutting region on the gripper finger. At the free end, the gripper finger preferably has an end protrusion which protrudes beyond the sliding surface and the cutting region and thus prevents yarn loops gripped by the gripper finger from being able to slip down from the gripper finger.

The loop gripper also has a retaining element. The retaining element is mounted so as to be pivotable about a pivot axis relative to the gripper finger. The pivot axis extends in a transverse direction at right angles to the extension direction. In one exemplary embodiment, the pivot axis may pass through the gripper finger, in particular in the region of the retained end of the gripper finger. In another exemplary embodiment, the pivot axis may be arranged outside of the gripper body at a distance from the underside of the gripper finger. In yet another exemplary embodiment, the pivot axis may pass through the gripper finger at a distance from the underside.

The retaining element is urged into a starting position by a means for presetting the starting position, in particular a spring means and/or a weight force. A retaining surface is provided on the retaining element. In the starting position of the retaining element, the retaining surface extends at right angles away from the sliding surface or obliquely to the sliding surface. Preferably, the retaining surface encloses a substantially right angle with the sliding surface or with the underside of the gripper finger in the cutting region, it being possible for said angle to lie in the range for example from 80° to 100°. The retaining surface faces toward the cutting region in the starting position of the retaining element. In one preferred exemplary embodiment, the retaining element bears against the sliding surface in the starting position.

In the starting position of the retaining element, the retaining surface may preferably adjoin the transition point between the sliding surface and the cutting region. In the starting position of the retaining element, the distance of the retaining surface from the transition point between the sliding surface and the cutting region is preferably at most 5 mm and more preferably at most 2 mm or 3 mm.

In the starting position, the retaining element prevents a yarn loop located in the cutting region from slipping out of the cutting region during the cutting operation and warping as a result of an increased tension. It is thus possible, when producing cut pile, to cut the yarn loops at the desired point as close as possible to the apex. The retaining surface forms, as it were, a stop for the yarn loops when the retaining element is in the starting position.

The retaining element can be moved out of the starting position, counter to the spring force of the spring means and/or the weight force, for example away from the sliding surface or into a cutout on the gripper finger, by a yarn loop sliding along the sliding surface of the gripper finger. During this, a pivoting movement of the retaining element takes place about the pivot axis. Once the yarn loop has entered the cutting region, the retaining element is moved back into the starting position by the means for presetting the starting position, for example the spring force of the spring means and/or a weight force.

Preferably, the retaining element in its starting position and more preferably in any possible position is arranged at a distance in the extension direction from the free end of the gripper finger. The longer part of the sliding surface is provided between the retaining element and the free end of the gripper finger.

In one preferred embodiment, the sliding surface of the gripper finger adjoins two lateral planes which are arranged parallel to one another and at a distance from one another in the transverse direction. The two planes bound an intermediate space, in which the sliding surface is located. The retaining element engages in this intermediate space and is preferably arranged in the intermediate space. In particular, the retaining element or at least the retaining surface is located entirely within the intermediate space.

In one exemplary embodiment, the width of the retaining element or of the retaining surface in the transverse direction is at most as large as the distance between the two lateral surfaces. Alternatively, this width of the retaining element or of the retaining surface may also be larger than the distance between the two lateral surfaces, so that the retaining element or the retaining surface passes through at least one of the two planes.

It is preferred if the retaining surface or the retaining element is arranged symmetrically in the intermediate space.

The gripper finger has, adjacent to the sliding surface and the cutting region, two side surfaces arranged at a distance from one another in the transverse direction. In one embodiment, the side surfaces may extend at least in some regions in the lateral planes or parallel thereto. The retaining element does not cooperate with the side surfaces. In no position does it bear against one of the two side surfaces. In addition, in no position does the retaining element form in the transverse direction a gap with a side surface, through which a yarn loop can be passed into the cutting region.

In one embodiment, the retaining element is provided exclusively for enabling yarn loops to pass between the sliding surface on the underside of the gripper finger and the retaining element into the cutting region, wherein the gap necessary for this is closed in the starting position. In another embodiment, the retaining element is provided in such a way that it can be moved out of the starting position into a recess when a yarn loop slides over the retaining element into the cutting region.

In one preferred exemplary embodiment, the cutting region of the gripper finger has a cutting edge. In the transverse direction, the cutting edge has a smaller dimension than the sliding surface. The cutting edge may be arranged eccentrically in relation to the sliding surface and the intermediate space. It is preferably possible that the cutting region is unsymmetrical in relation to a central plane passing through the gripper finger in its extension direction. This may take place for example in that a cutout is provided in the cutting region on a side surface of the gripper finger that points in the transverse direction.

In one preferred exemplary embodiment, the retaining element has a run-in surface on its side opposite the retaining surface. In the starting position of the retaining element, the run-in surface preferably directly adjoins the sliding surface. In the starting position of the retaining element, a first angle is formed between the sliding surface and the run-in surface, said first angle preferably being smaller than 90° and more preferably smaller than 70° and more preferably smaller than 45°. By virtue of this run-in surface, a yarn loop can pass very easily from the sliding surface into the cutting region and the retaining element can be urged out of its starting position counter to the force exerted by the means for presetting the starting position.

Preferably, the retaining element is arranged on a retaining body. The retaining body is arranged on the gripper body and is held there with a force fit and/or with a form fit and/or by a material bond.

The retaining element may be an integral part of the retaining body and may be connected to the rest of the retaining body without any seam or join. Alternatively, the retaining element may be mounted on the retaining body in a pivotable manner.

Preferably, the retaining body has the spring means. In one exemplary embodiment, the spring means may be an integral part of the retaining body. The spring means may act on the retaining element or may carry the retaining element. In one embodiment, the retaining element is arranged at one end of the spring means and can merge into the spring means without any seam or join.

In a further embodiment of the loop gripper, the retaining body may be mounted on the gripper finger. In particular, a recess which is open toward the underside may be provided on the gripper finger. The retaining body may be arranged in this recess, wherein the retaining surface protrudes from the recess in the starting position. As a yarn loop slides along, the retaining body or the retaining element is moved at least partially into the recess. Preferably, the recess is closed in the transverse direction by side cheeks of the gripper finger. In this embodiment, the retaining body may be urged or pivoted into the starting position by its own weight force when no opposing force is acting thereon. In addition or as an alternative, a spring means may be provided.

Advantageous embodiments of the loop gripper will become apparent from the dependent claims, the description and the drawing. Preferred exemplary embodiments of the loop gripper will be explained in detail below with reference to the appended drawing. In the drawing:

DETAILED DESCRIPTION

Figure 1:
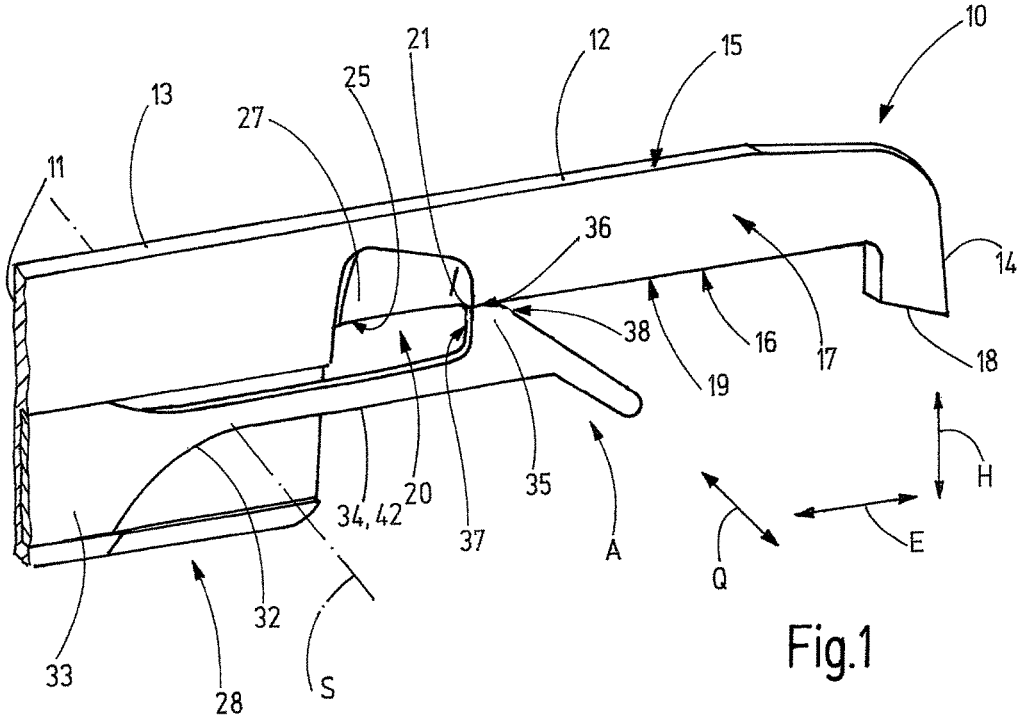
FIG. 1 shows a perspective partial view of a first exemplary embodiment of a loop gripper.
Figure 2:
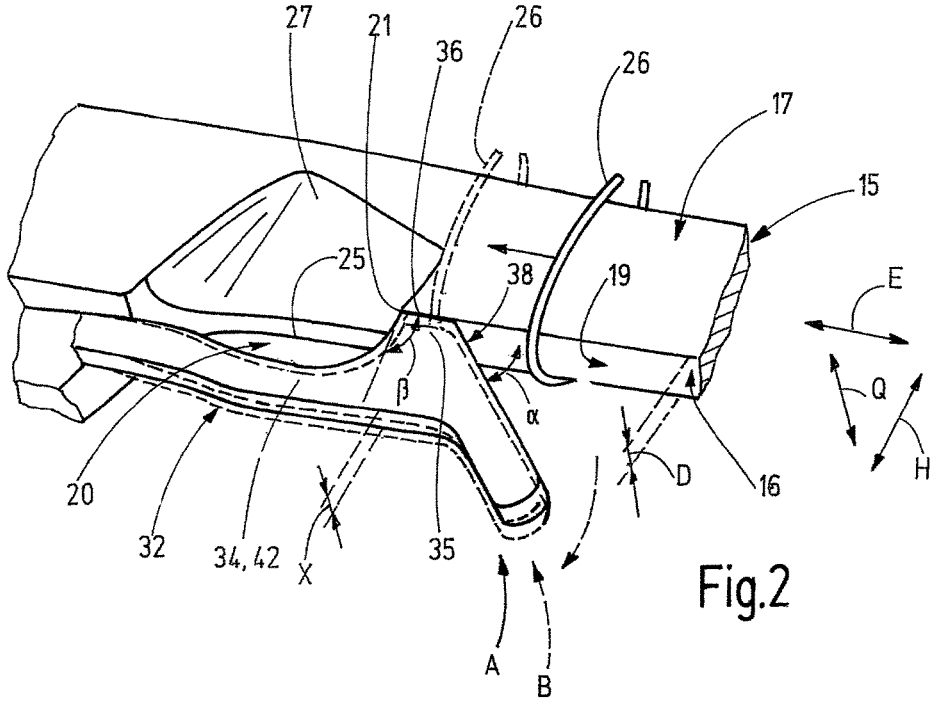
FIG. 2 shows a perspective partial view of the loop gripper of FIG. 1.

A first exemplary embodiment of a loop gripper 10 is illustrated in FIGS. 1 and 2. The loop gripper 10 has a gripper body 11, on which a gripper finger 12 is formed. The gripper finger 12 is an integral part of the gripper body 11 and extends in an extension direction E from a retained end 13 to a free end 14. The gripper finger 12 has an upper side 15 which, when producing cut pile, is assigned to a backing of the textile material produced. The gripper finger 12 also has an underside 16 opposite the upper side 15. Narrow sides of the gripper finger 12 are provided on the upper side 15 and on the underside 16. Said narrow sides are connected to one another by two side surfaces 17. The two side surfaces 17 are arranged at a distance from one another in a transverse direction Q at right angles to the extension direction E.

The direction at right angles to the transverse direction Q and at right angles to the extension direction E is referred to as the height direction H.

The gripper finger 12 forms a hook at its free end 14. This is achieved in that an end protrusion 18 protrudes substantially in the height direction H away from the adjoining region of the underside 16 of the gripper finger 12.

On the underside 16, the end protrusion 18 is adjoined by a sliding surface 19. The sliding surface 19 extends from the end protrusion 18 to a cutting region 20 of the gripper finger. The sliding surface 19 transitions into the cutting region 20 at a transition point 21. In the first exemplary embodiment of the loop gripper 10, the cutting region 20 is of unsymmetrical shape in relation to a central plane through the gripper finger 12, which is defined by the extension direction E and the height direction H. Provided in the cutting region 20 is a cutting edge 25 which preferably cooperates with a cutting blade (not shown) in order to cut yarn loops 26. A cutout 27 is formed in the gripper finger 12 laterally in the cutting region 20. The cutting blade moves along the gripper finger 12 and along the cutting edge 25 on the side opposite the cutout 27. The cutout 27 helps the cutting blade, together with the cutting edge 25, to be able to cut a yarn loop 26 close to the apex, that is to say in the region of the central plane through the gripper finger 12, so that as far as possible pile threads of equal length are obtained. The cutout 27 is open in the height direction H on the underside 16 and in the transverse direction Q on one of the two sides of the gripper finger 12.

On the side opposite the sliding surface 19, the cutting region 20 is adjoined by a retained region 28 of the gripper body 11 having the retained end 13 of the gripper finger 12.

The loop gripper 10 according to the first exemplary embodiment also has a retaining body 32. The retaining body 32 has an attachment part 33, by means of which it is attached to the gripper body 11 in the retained region 28, for example with a form fit and/or with a force fit and/or by a material bond (FIG. 1). Starting from the attachment part 33, a connecting part extends over the cutting region 20 to the free end 14 of the gripper finger 12. The connecting part 34 engages, so to speak, over the cutting region 20. At its end opposite the attachment part 33, a retaining element 35 is arranged on the connecting part 34 of the retaining body 32.

In the exemplary embodiment described here, the retaining element 35 has a bearing surface 36 which faces toward the sliding surface 19 and in a starting position A bears against a portion of the sliding surface 19. In the extension direction E, the bearing surface 36 is adjoined by a retaining surface 37 on the side facing toward the cutting region 20. On the side opposite the retaining surface 37, which side faces toward the free end 14 of the gripper finger 12, the retaining element 35 has a run-in surface 38.

In the starting position A, the run-in surface 38 encloses a first angle $\alpha$ with the sliding surface 19. The first angle $\alpha$ is configured as an acute angle and is preferably smaller than 70° or smaller than 60° or smaller than 45°. In the starting position A, the retaining surface 37 encloses a second angle $\beta$ with the sliding surface 19 at least in the region of the retaining surface 37 directly adjoining the sliding surface 19, said second angle being larger than the first angle $\alpha$ and preferably forming approximately a right angle and being for example in the range from 80° to 100°.

The retaining body 32 has a means for presetting the starting position and for example a spring means 42 which, in the first exemplary embodiment, is formed by the connecting part 34 of the retaining body 32. With the aid of the spring means 42, the retaining element 35 is biased into its starting position a. In the exemplary embodiment, the bearing surface 36 bears against the sliding surface 19 in the region of the transition point 21. It is preferred if the retaining surface 37 in the starting position A is arranged close to the transition point 21. Preferably, the distance in the extension direction E between the transition point 21 and the retaining surface 37 in the starting position A is at most 5 mm or at most 2 mm to 3 mm.

As illustrated in FIGS. 1 and 2, in the first exemplary embodiment of the loop gripper 10 the retaining body 32 is designed as an integral part without any seam or join. The attachment part 33, the connecting part 34 and the retaining element 35 merge integrally into one another without any seam or join.

The retaining element 35 can be pivoted out of the starting position and into a deflected position B (FIG. 2) about a pivot axis S counter to the spring force of the spring means 42. The pivoting movement of the retaining element 35 is not triggered by external control means but rather is caused exclusively by the spring means 42 of the retaining body 32 and the yarn loops 26 moved into the cutting region 20.

The first exemplary embodiment of the loop gripper 10 operates as follows:

When producing cut pile, the yarn loops are gripped by the gripper finger 12 and are located initially between the cutting region 20 and the end protrusion 18, so that the region around the apex of the yarn loop 26 bears against the sliding surface 19. By virtue of a relative movement between the backing and the loop gripper 10, the yarn loop 26 moves along the sliding surface 19 toward the cutting region 20 until it comes into contact with the retaining element 35 and in the present case the run-in surface 38. By a continued relative movement in the extension direction E, the yarn loop 36 presses against the run-in surface 38 and pivots the retaining element 35 about the pivot axis S out of the starting position A and into the deflected position B counter to the spring force of the spring means 42. A gap is thus created between the bearing surface 36 and the sliding surface 19, through which gap the yarn loop 26 can pass from the sliding surface 19 into the cutting region 20 (diagram shown in dashed line in FIG. 2). Since the first angle $\alpha$ is an acute angle, the force for deflecting the retaining element 35 into the deflected position B is sufficiently low.

Once the yarn loop 26 is located in the cutting region 20, it is cut there in the region of its apex by means of a cutting blade. During this, the yarn loop 26 cannot escape from the cutting region 20 since it butts against the retaining surface 37 of the retaining element 35 and is held back then at the latest. This leads to a considerably improved quality of the cut pile produced. Since, in the exemplary embodiment, the second angle β is larger than the first angle α, a yarn loop 26 can deflect the retaining element 35 out of the starting position A when the yarn loop moves into the cutting region 20. In the case of a reversed relative movement of the loop gripper 10 relative to the backing, on account of the larger angle β the required force that would be necessary in order to move a yarn loop 26 through between the retaining element 35 and the gripper finger 12 would be too great, so that the yarn loops 26 are securely held in the cutting region 20.

Figure 3:
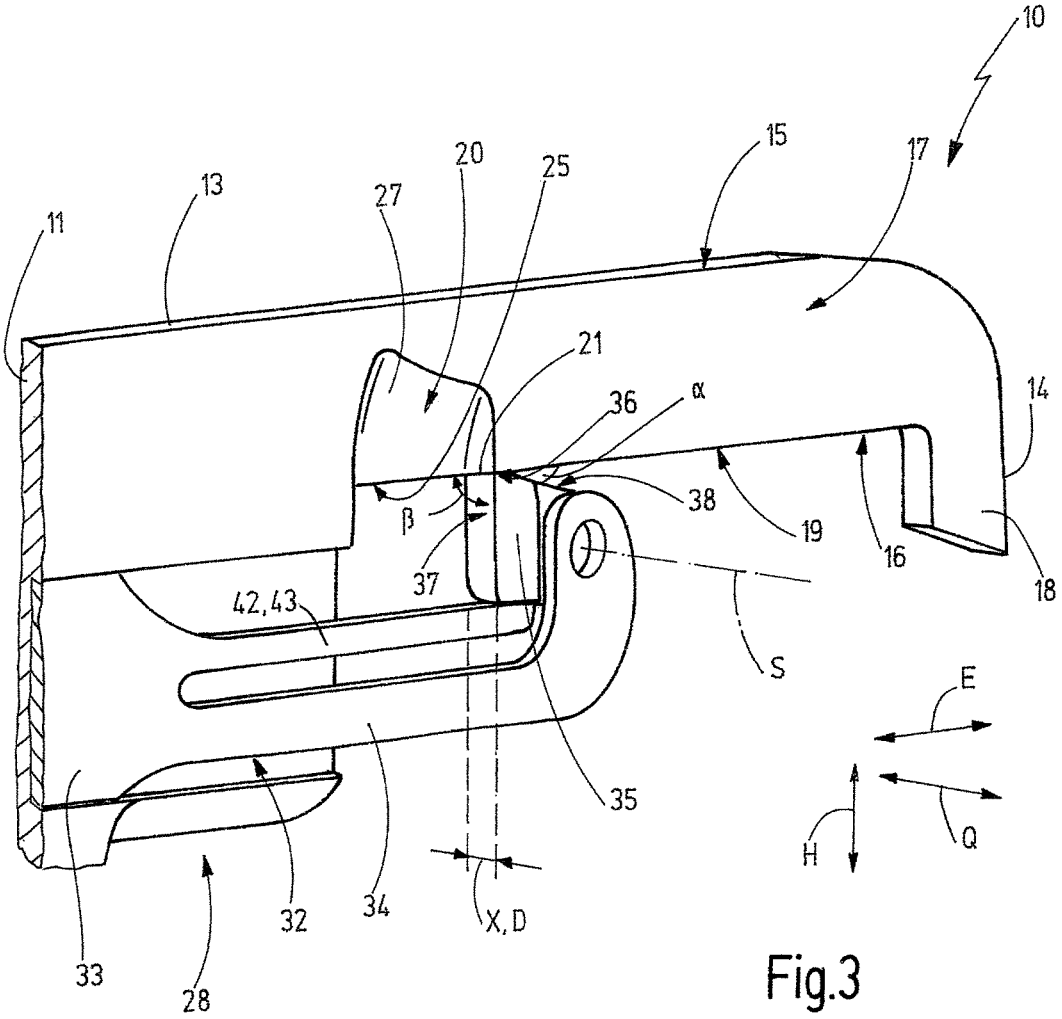
FIG. 3 shows a second exemplary embodiment of a loop gripper in a perspective partial view.

FIG. 3 shows a modified second exemplary embodiment of the loop gripper 10. The gripper body 11 with the gripper finger 12 is identical to the first exemplary embodiment shown in FIGS. 1 and 2, so that reference can be made to the description above.

The main difference of the second exemplary embodiment shown in FIG. 3 compared to the first exemplary embodiment of FIGS. 1 and 2 lies in the fact that the retaining element 35 is arranged as a separate part on the retaining body 32. The retaining element 35 is mounted at the end of the connecting part 34 opposite the attachment part 33 in such a way as to be able to pivot about the pivot axis S. While the pivot axis S in the first exemplary embodiment is arranged in the region of the retained portion 28, in the second exemplary embodiment the pivot axis S extends below the sliding surface 19. In both exemplary embodiments, the pivot axis S is arranged at a distance from the sliding surface 19 in the height direction.

Another difference compared to the first exemplary embodiment lies in the fact that, in the second exemplary embodiment shown in FIG. 3, the spring means 42 is formed separately from the connecting part 34. The spring means 42 is formed by a spring-elastic finger 43 which extends from the attachment part 33 to the retaining element 35 and applies a spring force to the retaining element 35 on the side opposite the bearing surface 36 in the height direction and presses the bearing surface 36 against the sliding surface 19. The spring-elastic finger 43 is for example an integral part of the retaining body 32.

The second exemplary embodiment of the loop gripper 10 shown in FIG. 3 otherwise corresponds to the first exemplary embodiment shown in FIGS. 1 and 2. The mode of operation is in principle the same as in the first exemplary embodiment, so that reference can be made to the description above.

Figure 4:
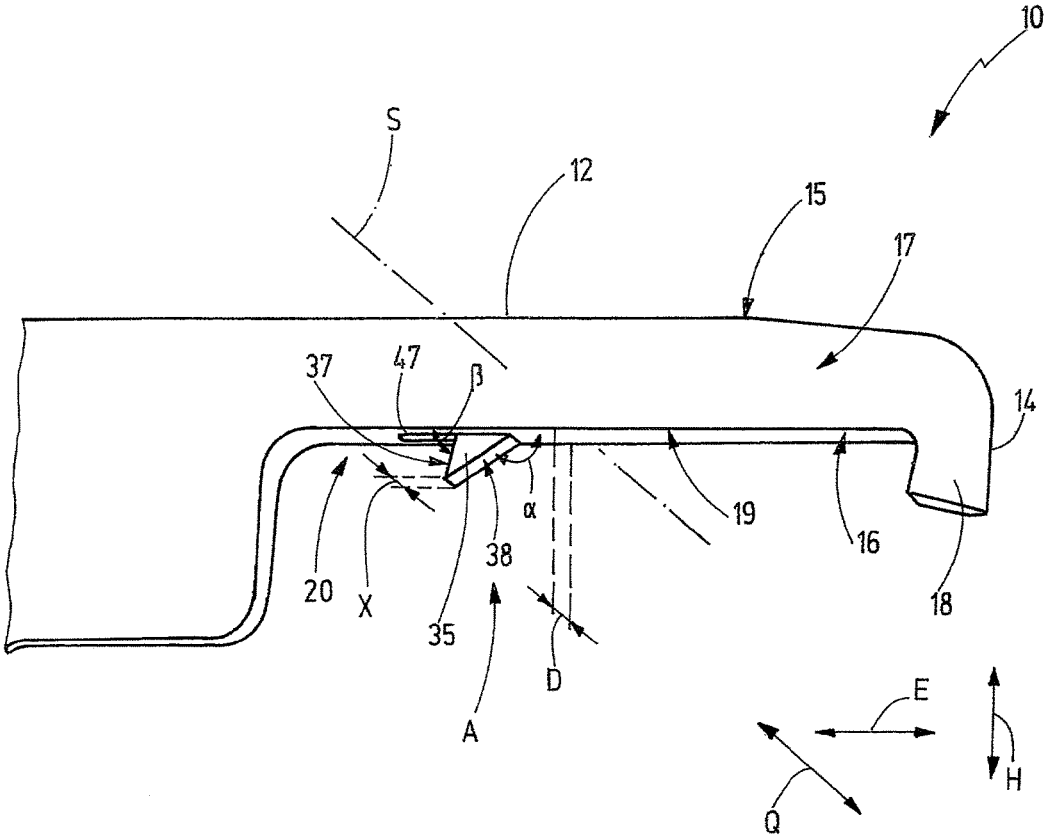
FIG. 4 shows a third exemplary embodiment of a loop gripper in a perspective partial view.

A third embodiment of the loop gripper 10 is illustrated schematically in FIG. 4. In this embodiment, the retaining body 32 with the retaining element 35 is pivotably mounted within a recess 47 of the gripper finger 12. In the starting position A, the retaining element 35 protrudes out of the recess 47 and protrudes beyond the sliding surface 19 and/or the underside 16 in the cutting region 20 of the gripper finger 12. The recess 47 is to this end open toward the underside 16. In the transverse direction Q, the recess 47 is closed by side cheeks which each have a part of the side surfaces 17.

In the illustrated exemplary embodiment, the retaining element 35 has an approximately triangular shape. Unlike in the previous exemplary embodiments, the first angle α is configured as an obtuse angle and is preferably larger than 100° and more preferably larger than 120° or 130°. The second angle β may be configured as a substantially right angle and, as in the other exemplary embodiments, may lie for example in the range from 80° to 100°.

In this embodiment, the means for presetting the starting position may generate its force for urging the retaining element 35 into the starting position A by the weight force of the retaining body 35. In addition or as an alternative, a spring means 42 may also be provided. When a yarn loop 26 moves along the gripper finger 12 in the extension direction E, the retaining element 35 is pivoted into the recess 47 counter to the weight force and/or spring force so that the yarn loop 26 can pass over the retaining element 35 from the sliding surface 19 into the cutting region 20. A pivoting movement of the retaining element 35 out of the starting position A is preferably possible only in one direction of pivoting and for example in the clockwise direction about the pivot axis S. This prevents yarn loops 26 located in the cutting region 20 from being able to leave the cutting region 20 by moving the retaining element 35 into the recess 47.

In all exemplary embodiments, at least the retaining surface 37 and/or the entire retaining element 35 has in the transverse direction Q a width X which is at most as large as the distance D between two lateral planes which adjoin the sliding surface 19 from opposite sides in the transverse direction Q. The two lateral planes are oriented parallel to one another and are defined by the extension direction E and the height direction H. Each lateral plane contains an edge between the sliding surface 19 and the respectively adjoining side surface 17. The two lateral planes define an intermediate space, within which the retaining surface 37 and/or the run-in surface 38 and preferably the retaining element 35 is arranged. In the second exemplary embodiment shown in FIG. 3, bearing means provided for pivotably mounting the retaining element 35 on the retaining body 32, such as pins, bolts or the like, may pass through one or both lateral planes.

In the preferred exemplary embodiments, the retaining plane 37 and the run-in surface 38 are arranged and configured centrally and preferably symmetrically in relation to a central plane which passes through the gripper finger 12 between the two lateral planes. Other parts of the retaining body 32 may be located outside of the intermediate space between the lateral planes or may pass through at least one of the lateral planes.

The invention relates to a loop gripper 10 for a tufting machine. The loop gripper 10 has a gripper body 11 with a gripper finger 12 which extends in an extension direction E from a retained end 13 to a free end 14. On the underside 16 of the gripper finger 12, there is a cutting region 20 which transitions into a sliding surface 19 at a transition point 21. Located in the region of the transition point 21 is a retaining element 35 which is mounted so as to be pivotable about a pivot axis S relative to the gripper finger 12. The pivot axis S extends in a transverse direction Q at right angles to the extension direction E. The retaining element 35 is urged into a starting position A by a force, for example a spring force of a spring means 42 and/or a weight force. In the starting position A, a retaining surface 37 of the retaining element 35 extends obliquely or at right angles away from the sliding surface 19.

LIST OF REFERENCE SIGNS

10 loop gripper
11 gripper body
12 gripper finger
13 retained end of the gripper finger
14 free end of the gripper finger
15 upper side
16 underside
17 side surface
18 end protrusion
19 sliding surface

20 cutting region
21 transition point
25 cutting edge
26 yarn loop
27 cutout
28 retained region of the gripper body
32 retaining body
33 attachment part
34 connecting part
35 retaining element
36 bearing surface
37 retaining surface
38 run-in surface
42 spring means
43 finger
47 recess
α first angle
β second angle
A starting position
B deflected position
D distance between the lateral planes
E extension direction
H height direction
Q transverse direction
S pivot axis
X width of the retaining surface or of the retaining element

The invention claimed is:

1. A loop gripper (10) for a tufting machine, the loop gripper comprising:

a gripper finger (12) formed on a gripper body (11) and extending in an extension direction (E) from a retained end (13) to a free end (14), which gripper finger has on its underside (16) a cutting region (20) and immediately following the cutting region (20), between the cutting region (20) and the free end (14), a sliding surface (19) for yarn loops (26), wherein the gripper finger (12) has at the free end (14) an end protrusion (18) that protrudes beyond the sliding surface (19), a retaining element (35) which has a retaining surface (37) and which is mounted to be pivotable relative to the gripper finger (12) about a pivot axis (S) which extends in a transverse direction (Q) at right angles to the extension direction (E), a means for presetting a starting position for the retaining element by generating a force on the retaining element (35) to urge the retaining element (35) into a starting position (A) in which the retaining surface (37) extends away from the sliding surface (19) and faces toward the cutting region (20).

2. The loop gripper according to claim 1, wherein the force of the means for presetting the starting position is a spring force of a spring means (42) and/or a weight force of the retaining element (35) or of a retaining body (32) connected to the retaining element (35).

3. The loop gripper according to claim 1, wherein the sliding surface (19) of the gripper finger (12) adjoins two lateral planes which are arranged parallel to one another and at a distance (D) from one another in a transverse direction (Q), said lateral planes bounding an intermediate space.

4. The loop gripper according to claim 3, wherein the retaining element (35) engages in the intermediate space.

5. The loop gripper according to claim 4, wherein the retaining element (35) is arranged in the intermediate space.

6. The loop gripper according to claim 3, wherein the retaining element (35) has in the transverse direction (Q) a width (X) which is at most as large as the distance (D) between the two lateral planes.

7. The loop gripper according to claim 3, wherein the retaining element (35) has in the transverse direction (Q) a width (X) which is larger than the distance (D) between the two lateral planes.

8. The loop gripper according to claim 1, wherein the gripper finger (12) has two side surfaces (17) which adjoin the sliding surface (19), wherein the retaining element (35) does not come into contact with either of the two side surfaces (17), and wherein the retaining element (35) does not form with either of the two side surfaces (17) a gap for the passage of a yarn loop (26).

9. The loop gripper according to claim 1, wherein the cutting region (20) has a cutting edge (25).

10. The loop gripper according to claim 1, wherein the cutting region (20) is unsymmetrical in relation to a central plane passing through the gripper finger (12) in its extension direction (E).

11. The loop gripper according to claim 9, wherein the cutting region (20) has a smaller dimension than the sliding surface (19) in a transverse direction (Q) which is oriented parallel to the pivot axis (S).

12. The loop gripper according to claim 1, wherein the retaining element (35) has, on its side opposite the retaining surface (37), a run-in surface (38) which in the starting position (A) of the retaining element (35) encloses an acute first angle (α) with the sliding surface (19).

13. The loop gripper according to claim 12, wherein the retaining surface (37), in the starting position (A) of the retaining element (35), encloses with the sliding surface (19) a second angle (β) that is larger than the first angle (α).

14. The loop gripper according to claim 1, wherein the retaining element (35) is arranged on a retaining body (32), the retaining body (32) being arranged on the gripper body (11).

15. The loop gripper according to claim 14, wherein the retaining element (35) is an integral part of the retaining body (32) or is arranged on the retaining body (32) in a pivotable manner.

16. The loop gripper according to claim 2, wherein the retaining element (35) is arranged on a retaining body (32), the retaining body (32) being arranged on the gripper body (11) and the retaining body (32) has the spring means (42).

17. The loop gripper according to claim 16, wherein the spring means (42) is an integral part of the retaining body (32).

18. The loop gripper according to claim 14, wherein the retaining body (35) is arranged in a recess (47) which is provided in the gripper finger (12) and which is open toward the underside (16).

* * * * *